US005245971A

United States Patent [19]

Rembold et al.

[11] Patent Number: 5,245,971

[45] Date of Patent: Sep. 21, 1993

[54] FUEL-INJECTION PUMP FOR INTERNAL-COMBUSTION ENGINES

[75] Inventors: Helmut Rembold, Stuttgart; Ernst Linder, Mühlacker; Gottlob Haag, Markgröninen, all of Fed. Rep. of Germany

[73] Assignee: Robert Bosch GmbH, Stuttgart, Fed. Rep. of Germany

[21] Appl. No.: 663,926

[22] PCT Filed: Jul. 26, 1990

[86] PCT No.: PCT/DE90/00573

§ 371 Date: Mar. 25, 1991

§ 102(e) Date: Mar. 25, 1991

[87] PCT Pub. No.: WO91/02897

PCT Pub. Date: Mar. 7, 1991

[30] Foreign Application Priority Data

Aug. 23, 1989 [DE] Fed. Rep. of Germany ..... 3927742

[51] Int. Cl.[5] ..... F02M 41/00

[52] U.S. Cl. ..... 123/450; 123/506; 123/387

[58] Field of Search ..... 123/450, 449, 458, 387, 123/506, 385; 417/462

[56] References Cited

U.S. PATENT DOCUMENTS

| | | | |
|---|---|---|---|
| 3,046,894 | 7/1962 | Machen | 123/450 |
| 3,323,506 | 6/1967 | Pigeroulet | 123/450 |
| 3,615,043 | 10/1971 | Hussey | 123/450 |
| 3,752,138 | 8/1973 | Gaines | 123/450 |
| 4,200,072 | 4/1980 | Bailey | 123/450 |
| 4,270,141 | 9/1988 | Bonin | 123/387 |
| 4,538,580 | 9/1985 | Straubel | 123/450 |
| 4,574,759 | 9/1986 | LeBlanc | 123/450 |
| 4,840,162 | 6/1989 | Brunel | 123/450 |

*Primary Examiner*—Carl S. Miller

*Attorney, Agent, or Firm*—Edwin E. Greigg; Ronald E. Greigg

[57] ABSTRACT

A fuel-injection pump, especially a direct fuel injection in spark-ignition internal-combustion engines, with at least one pump for generating a fuel flow under pressure and with a rotary slide valve moved synchronously with the drive shaft of the internal-combustion engine and intended for assigning the fuel flow to at least one injection port of the internal-combustion engine and/or for branching off the fuel flow under pump pressure into a return line, the rotary slide valve is mounted so as to be displaceable to a limited extent in the direction of its axis of rotation and/or so as to be rotatable to a limited extent in relation to the rotary drive of the rotary slide valve. Preferably, at the same time, the rotary position or displacement position of the rotary slide valve can be determined in dependence on an operating parameter of the internal-combustion engine, with the result that the axial displacement of the rotary slide valve counteracts a seizure of the rotary slide valve in its guide and determination in dependence on operating parameters affords the possibility of adjusting the injection time over a larger angular sector than would be possible in view of the geometrical limits placed on the design of the rotary slide valve.

22 Claims, 2 Drawing Sheets

FUEL-INJECTION PUMP FOR INTERNAL-COMBUSTION ENGINES

Figure 1:
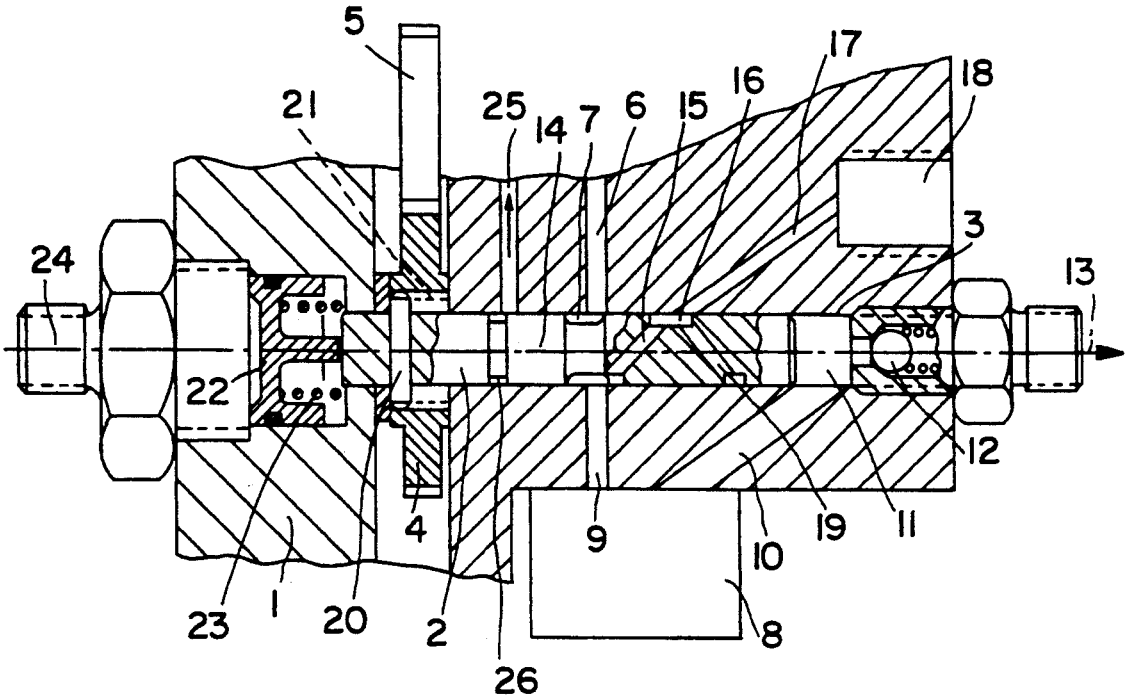

The invention relates to a fuel-injection pump.

A fuel-injection pump of this type is to be taken, for example, from the older German Application P 3,804,025, now U.S. Pat. No. 4,879,984. In this older version of a fuel-injection pump, the fuel flow was distributed by a plurality of pumps to the injection ports of injection valves by means of a rotary slide valve which was synchronously driven in rotational movement at a predetermined transmission ratio relative to the engine shaft. The injection quantity and injection time were controlled by opening or closing an overflow channel to a relief volume by means of a solenoid valve. When it is necessary to distribute the fuel flow to a plurality of cylinders of an internal-combustion engine, with the increasing number of cylinders of the internal-combustion engine there is a reduction of the particular angular sector of the rotary slide valve which is available for geometrical reasons and over which the injection quantity and the injection time for an individual cylinder can be influenced by means of the solenoid valve. After operating for a relatively long period of time, a rotary slide valve driven simply in rotational movement tends to exhibit signs of wear which in turn cause the rotary slide to seize in its guide.

The fuel-injection pump according to the invention affords the possibility, by means of an axial displacement of the rotary slide valve, of counteracting a seizure of the rotary slide valve in its guide. At the same time, an axial displacement of the rotary slide valve, with an appropriate design of the circumferentially extending recesses for distributing the fuel flow to individual cylinders, and/or a relative rotation of the rotary slide valve in relation to the rotary drive allows the possibility of adjusting the injection time over a larger angular sector than would be possible otherwise in view of the geometrical limits placed on the configuration of the circumferentially measured length of the grooves of the rotary slide valve which serve for distribution. Particularly in internal-combustion engines with more than four cylinders, without an additional possibility of influencing the shift of the injection time, the geometrical limits of the rotary slide valve itself are already clearly detectable.

To shift the effective angular sector for distributing the fuel flow to an injection port of a particular cylinder of the internal-combustion engine, advantageously the design is such that the rotary slide valve can be fixed in its rotary position or displacement position in dependence on an operating parameter of the internal-combustion engine. Considered as an operating parameter of the internal-combustion engine here is primarily the speed of the internal-combustion engine or else a control variable related to the speed of the internal-combustion engine, such as, for example, the fuel pressure of a fuel pump driven in synchronism with the engine shaft, an oil pressure or the like. The corresponding control variable can also be derived from a centrifugal governor.

To influence the particular desired displacement position of the rotary slide valve dependent on an operating parameter in the direction of its axis of rotation, the rotary slide valve can advantageously be displaceable in the direction of this axis of rotation against a stop adjustable in dependence on an operating parameter. The measure of providing a separate stop of this type makes it possible in a simple way to utilise a pressure dependent on an operating parameter for adjusting the stop, advantageously the design being such that the adjustable stop is formed by a stop piston which can be subjected hydraulically to speed-dependent pressure. Instead of a separate stop piston of this type, the rotary slide valve itself can also be designed in a simple way as a piston, in which case subjecting such a rotary slide valve designed as a piston to a pressure medium on the piston end face can be utilised directly for displacing the rotary slide valve, and advantageously the working space of this piston can be subjected to a pressure medium counter to the force of a spring acting on the rotary slide valve. A pressure suitable for the purpose of displacing the rotary slide valve can be derived directly from the high-pressure side of the pump, and if the rotary slide valve designed as a piston is subjected to a pump pressure of this kind the design is preferably such that the working space of the rotary slide valve designed as a piston is connected to the return line via a throttle and, if appropriate, a relief valve. The pump pressure is at the same time reduced via the throttle, and, in view of the dynamic flow behaviour of the fuel, a displacement pressure corresponding to an operating parameter of the internal-combustion engine occurs on that side of the rotary slide valve which is designed as a piston. In all instances where the rotary slide valve is merely displaced in the axial direction of its axis of rotation and where special modifications have not at the same time been made to the circumferentially extending grooves for distributing the fuel flow to the cylinders, the axial displacement initially only affords the advantage of counteracting a seizure of the rotary slide valve. But if, in addition, the design of the circumferentially extending grooves of the rotary slide valve which serve for distribution is changed or a rotation of the rotary slide valve relative to its drive is executed, the angular sector over which it is possible for the injection operation to be influenced by the solenoid valve can be adjusted. Advantageously, here, the design can be such that the rotary slide valve is coupled to the rotary drive via oblique teeth or grooves. During an axial displacement of the rotary slide valve, such a coupling of the rotary slide valve to the rotary drive via oblique teeth or grooves leads at the same time, because of the oblique teeth or grooves, to a relative rotation of the rotary slide valve in relation to the rotary drive. In an especially simple way, here, the design can be such that the rotary slide valve engages via at least one bolt oriented essentially radially relative to the axis of rotation into an oblique groove on the inner circumference of a hollow driving wheel connected to the rotary drive, thereby ensuring an especially compact design.

The synchronous rotary drive of the rotary slide valve can be derived directly from the engine shaft in a simple way. To obtain a uniform pressure level even when there is only a small number of piston pumps, the pump camshaft can be driven at the correspondingly lowest possible speed, but a speed higher than that of the drive shaft of the rotary slide valve, for which purpose the design is advantageously such that the hollow driving wheel of the rotary slide valve is designed as a gear-wheel meshing with a gearwheel of a pump camshaft, and such that the gearwheel of the pump camshaft has a smaller diameter than the hollow driving wheel of the rotary slide valve.

When a shift of the angular sector effective for controlling the injection operation is to be achieved by means of a simple axial displacement of the rotary slide valve without a relative rotation of the rotary slide valve in relation to its rotary drive, this can be achieved in a simple way, if the rotary slide valve has on its circumference control grooves extending obliquely relatively to the axis. If such control grooves extending obliquely relative to the axis are provided, the width of these control grooves can correspond essentially to the diameter of the bores opening on to the control grooves. But if an axial displacement of the rotary slide valve together with a relative rotation of the rotary slide valve in relation to its drive is to be permissible in order to adjust the effective angular sector, advantageously the design is such that the circumferential grooves of the rotary slide valve have an axially measured width which is at least equal to the maximum axial displacement travel of the rotary slide valve occurring during the rotation of the rotary slide valve in relation to its rotary drive. Likewise, during the axial displacement of the rotary slide valve, it is necessary to ensure that fuel is fed under pressure in each axial displacement position, for which purpose the design is advantageously such that a circumferential groove of the rotary slide valve connected to the pump delivery connection has a width in the axial direction corresponding to the maximum axial displacement travel of the rotary slide valve.

To achieve a fluid pressure suitable for displacing the rotary slide valve in the axial direction, in a simple way the design can be such that the injection time and the injection period or quantity can be fixed by means of a solenoid valve opening into the return and connected to a delivery line of the pump or pumps, and such that the solenoid valve is connected to the return, with the working space of the rotary slide valve designed as a piston or the working space of a regulating piston and a throttle being interposed, thereby at the same time ensuring especially compact constructional dimensions.

To ensure that a reproducible injection quantity is obtained irrespective of the number Z of engine cylinders, care is taken to ensure, by the choice of the transmission ratio of pump speed to engine speed, that the pump feed rate during injection is always the same from cylinder to cylinder. Where a 3-cylinder eccentric pump is concerned, the ratio is preferably selected according to the formula (Z.120°)/720°.

Figure 2:
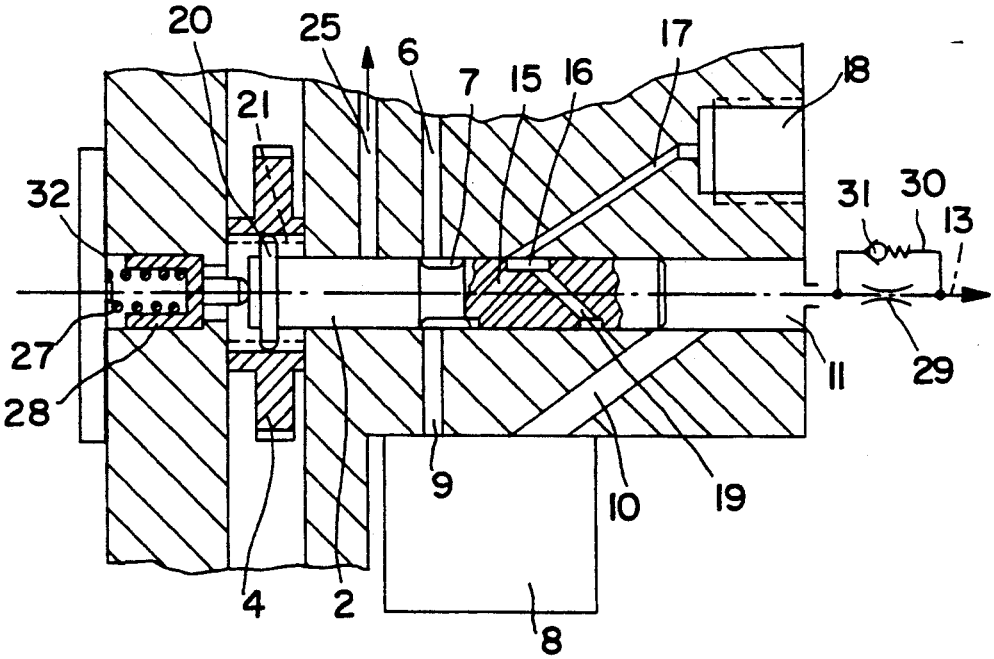
Figure 3:
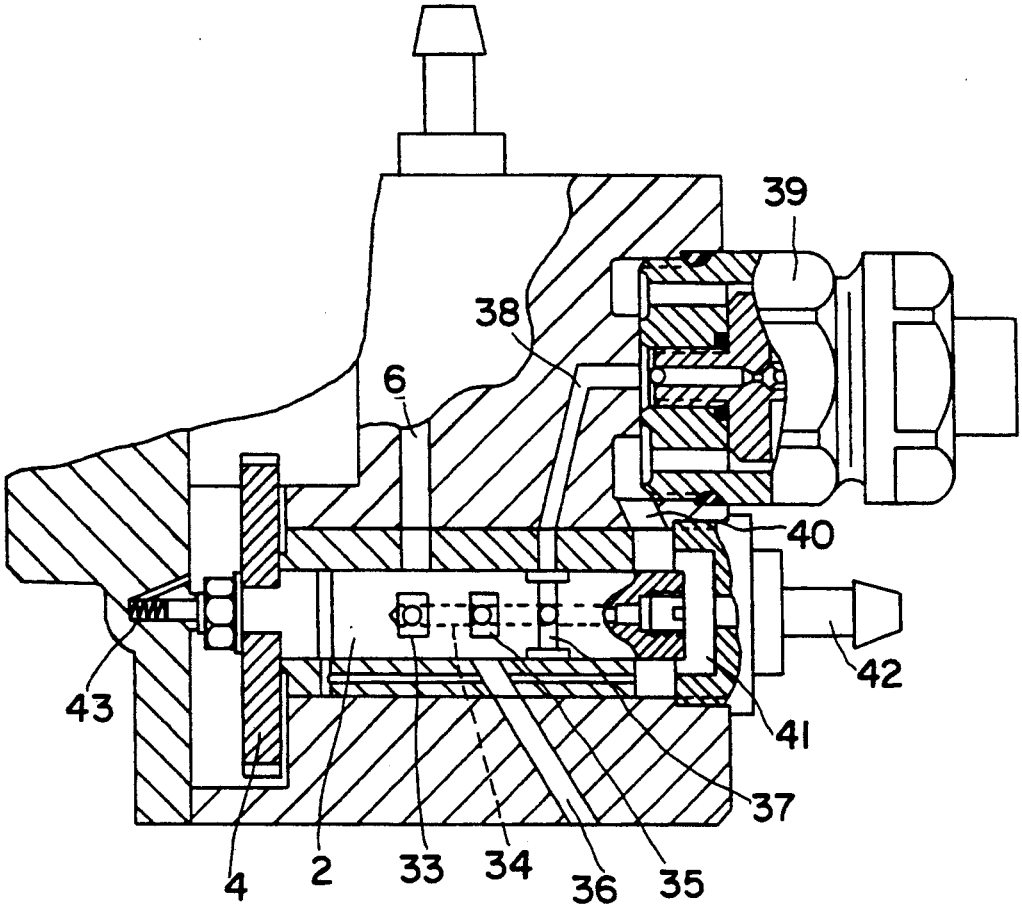

The invention is explained in more detail below by means of exemplary embodiments illustrated diagrammatically in the drawing. In this, FIG. 1 shows a partial section through a first embodiment of a fuel-injection pump according to the invention in the region of the rotary slide valve; FIG. 2 shows a modified embodiment of a fuel-injection pump according to the invention in a representation similar to that of FIG. 1; and FIG. 3 shows a further modified embodiment, in which a seizure of the rotary slide valve is largely to be prevented by means of an axial movement of the latter.

In FIG. 1, 1 denotes a pump casing of a distributor fuel-injection pump, in which a rotary slide valve 2 acting as a distributor is arranged rotatably and axially displaceably in a cylindrical bore 3. The rotary slide valve 2 is driven via a hollow gearwheel 4 which meshes with a gearwheel 5 of a pump camshaft not shown in any more detail. At the same time, the gearwheel 5 of the pump camshaft has a smaller diameter than the driving wheel 4 of the rotary slide valve 2, and by the relative sizes of the gearwheels 4 and 5 a desired transmission ratio can be set between the rotational speed of the pump camshaft, not shown in any more detail, which feeds fuel under pressure to the rotary slide valve via a feed line 6 by means of a plurality of pump pistons, and the rotational speed of the rotary slide valve 2, the rotary slide valve 2 being driven in synchronism with the drive shaft of the internal-combustion engine and always at half the speed of the drive shaft. Via the feed line, designated by 6, which constitutes the collecting line for the fuel under pressure coming from the individual pump elements, the fuel under pressure enters an annular space 7 which is formed by a circumferential recess or groove extending in the axial direction of the rotary slide valve 2. Furthermore, a line 9 leading to a solenoid valve 8 opens out in the region of the circumferential groove 7 of the rotary slide valve 2, the solenoid valve 8 controlling both the start of injection and the injection quantity or injection period. The fuel under pressure, cut off via the solenoid valve in its opened position, passes via a bore 10 into a working space 11 limited by the rotary slide valve 2 and belonging to the rotary slide valve designed at the same time as a stop piston, in order to achieve a larger possible injection range by means of an axial displacement of the rotary slide valve 2 and/or a relative rotation of the latter in relation to its rotary drive, as will also be explained in more detail later. At the same time, the pressure in the working space 11 is adjusted via a pressure-holding valve 12, and the fuel issuing from the working space 11 flows into a return line, indicated diagrammatically at 13, to the tank.

For an injection, after the solenoid valve 8 has closed the fuel under pressure passes out of the annular space or circumferential groove 7 of the rotary slide valve into a bore 15 extending obliquely relative to the axis 14 of the rotary slide valve, to a recess or groove 16 which is arranged on the circumference of the rotary slide valve and which, in an appropriate rotary position of the rotary slide valve, delivers fuel under pressure via a feed line 17 to an injection valve 18 indicated diagrammatically. For pressure compensation, a pressure-compensating bore 19 located in the rotary slide valve opens into the recess 16 at an angle corresponding to the angle of the bore 15.

According to the number of cylinders of the internal-combustion engine, a corresponding number of feed bores to the individual injection valves of the engine cylinders are provided in a uniform distribution, in a similar way to the bore 17, and for separating the respective injection operations in the individual cylinders there is only a restricted angular sector available during the rotational movement of the rotary slide valve 2 taking place in synchronism with the engine shaft. So that the angular sector useful for an injection can be varied within wider limits than those governed by the geometrical conditions, the rotary slide valve 2 is displaced and/or rotated in relation to the driving gearwheel 4. For this purpose, on the rotary slide valve 2 there are two bolts 20 which extend essentially radially relative to the axis 14 of the rotary slide and which engage into diagrammatically indicated grooves 21 extending obliquely relative to the axis 14 of the rotary slide and located on the inner circumference of the driving gearwheel 4. During an axial displacement of the rotary slide valve 2, a rotation of the rotary slide valve 2 relative to the driving wheel 4 takes places via the radial bolts 20 engaging into the oblique grooves 21, and subsequently the recess 16 comes at another moment in time, that is to say in another angular sector of the engine drive shaft, into a position aligned with a bore 17 to an injection valve, so that the start of injection can thereby be adjusted within wide limits. At the same time, via the pressure prevailing in the working space 11, the rotary side valve is held bearing against a control piston 22 which is loaded by a spring 23. The control piston is loaded via a diagrammatically indicated feed line 24 in dependence on an operating parameter, such as, for example, the engine-oil pressure or the petrol inflow pressure. As mentioned above, the resulting axial movement of the control piston and therefore of the rotary slide valve is converted, via the radial bolts running in the oblique groove 21, into a rotational movement of the rotary slide valve 2 in relation to the pump drive shaft and therefore to the engine drive shaft. To allow for the axial displacement of the rotary slide valve 2, both the recess 7 interacting with the inflow 6 and the recess 16 interacting respectively with an injection valve via the bore 17 have a width in the direction of the axis of the rotary slide valve which is at least equal to the maximum axial displacement travel of the rotary slide valve 2.

Instead of rotating the rotary slide valve 2 relative to the driving wheel 4 via radial bolts or pins engaging into oblique grooves, a helical toothing can also be provided on the rotary slide valve 2 and on the inner circumference of the driving wheel 4, in order thereby to convert an axial movement of the rotary slide valve 2 into a relative rotation in relation to the driving wheel 4.

In FIG. 1, furthermore, 25 denotes a leakage bore which interacts with a circumferential groove 26 on the rotary slide valve 2.

In the embodiment according to FIG. 2, the reference symbols of FIG. 1 have been preserved for identical components. Here, once again, an axial movement of the rotary slide valve 2 is converted into a rotational movement of the latter relative to the driving wheel 4 in order to adjust the angular sector useful for an injection. At the same time, the rotary slide valve is subjected to stress in the axial direction via a piston 28 loaded by a spring 27, and the axial displacement of the rotary slide valve 2 designed as a piston, taking place in the working space 11, is utilised for adjusting the axial position and therefore the rotary position relative to the driving wheel. Thus, the fuel flow cut off by the solenoid valve 8 passes out of the working space 11 via a throttle 29 into the return 13 to the tank. With an increasing speed, the fuel quantity entering the working space 11 increases, and there is therefore established in the space 11 a higher mean pressure level, by means of which the rotary slide valve 2 is displaced towards the spring-loaded piston 28. Furthermore, a relief valve 31 is inserted in a bypass line 30 relative to the throttle 29, so that after the regulating distance has been covered, that is to say after the piston 28 comes to bear against the stop 32, the relief valve opens into the return line 13. At the same time, the throttle 29 and the prestressing force of the spring 27 are coordinated in such a way that an axial movement of the rotary slide valve takes place only beyond a predetermined speed. Furthermore, strong pressure pulsations which possibly occur in the working space 11 and which would lead to indeterminate movements of the rotary slide valve 2 can be damped or smoothed as a result of an appropriate design of the spring characteristic.

Instead of converting an axial displacement of the rotary slide valve into a relative rotation in relation to the driving wheel 4 for varying the angular sector useful for an injection, it would also be possible to displace the rotary slide valve 2 in the axial direction only. Thus, instead of the circumferential groove or recess 16 which extends over a width corresponding to the maximum axial displacement travel and which interacts with the individual inflow bores 17 to the injection valves 18, this circumferential groove is arranged obliquely relative to the axis 14 of the rotary slide valve 2, so that in the event of an axial displacement of the rotary slide valve 2 in different rotary positions the feed bores 17 are crossed, and in this case, of course, the circumferential recess 16 would have to extend over an angular sector larger than that of the embodiment illustrated in FIGS. 1 and 2.

FIG. 3 shows a modified embodiment of the rotary slide valve 2 which is once again connected to the pump drive shaft or the engine shaft via a driving wheel 4 in a way not shown in any more detail. By way of the inflow bore 6, fuel passes into a axial channel 34 of the rotary slide valve 2 via recesses 33 provided on the circumference of the rotary slide valve, and in corresponding angular positions fuel under pressure enters feed lines 36 to injection valves via recesses 35 arranged in a further plane. Via the axial channel 34, a further circumferential groove 37 is connected to a relief bore 38, in which is inserted a solenoid valve 39 similar to the solenoid valve 8. The fuel flow cut off via the solenoid valve 39 once more passes via a line 40 into a working space 41 which is connected to a return 42. Since a pressure wave is triggered in the return whenever the fuel flow is cut off, the rotary slide valve 2 is thereby subjected to stress in the axial direction and moved in the axial direction counter to the force of a spring 43. Since, in contrast to the design according to FIGS. 1 and 2, neither a pressure-holding valve nor a throttle and a relief valve are inserted in the return 42, after the pressure wave occurs, the pressure in the working space 41 drops quickly again and the rotary slide valve 2 is once more moved back into its normal position by the force of the spring 43. An oscillating axial movement of the rotary slide valve 2 is thereby superposed on the rotational movement, and this oscillating movement can prevent a seizure of the rotary side valve 2. This ensures more favourable lubrication conditions which are of considerable importance especially in a petrol-driven engine. In contrast to the embodiments according to FIGS. 1 and 2, therefore, in this embodiment the rotary slide valve 2 is not fixed in the axial displacement position and/or the relative rotary position in relation to the driving wheel 4, which are selected in dependence on operating parameters, so that no adjustment of the angular sector useful for an injection is carried out.

We claim:

1. A fuel injection pump for direct fuel injection in internal combustion engines having a drive shaft and with externally supplied ignition, at least one pump for generating a fuel stream with pressure brought to an injection pressure, a rotary slide valve which is moved synchronously with the drive shaft of the engine, said rotary slide valve has a distributor opening on a jacket face that upon a rotation of the rotary slide, said distributor opening comes to coincide with one of a plurality of pressure lines distributed over a circumference of the rotary slide and which lead away from a bore that receives the rotary slide, each of said pressure lines leads to one injection location of the engine, and the distributor opening communicates continuously with the at least one pump and with a relief line in which an electrically controlled valve is disposed and by a closing state said electrically controlled valve controls a high-pressure feeding of fuel from the distributor opening to the injection locations, the injection line, downstream of the electrically controlled valve, discharges into a work chamber enclosed by a face end of the rotary slide in the bore, said work chamber is relieved in throttled fashion and the rotary slide is displaceable axially counter to a restoring force.

2. A fuel injection pump as defined by claim 1 in which a pressure limiting valve for throttling a relief of the work chamber is disposed in a return line leading away from the work chamber toward the relief side.

3. A fuel injection pump as defined by claim 2 in which a fixed throttle is disposed parallel to the pressure limiting valve and means are provided by which upon displacement of the rotary slide, the rotary position of the distributor opening relative to the rotary position of the drive shaft is variable.

4. A fuel-injection pump, especially for direct fuel injection in spark-ignition internal combustion engines, comprising at least one pump for generating a fuel flow under pressure and with a rotary slide valve moved synchronously with a drive shaft of the internal combustion engine and intended for assigning the fuel flow to at least one injection port of the internal combustion engine and for branching off the fuel flow under pressure into a return line, in which the rotary slide valve (2) is provided with at least one bolt (20) which is oriented essentially radially relative to the axis of rotation of the rotary slide valve (2) which engages an oblique groove (21) on an inner circumference of a hollow driving wheel (4) connected to the rotary drive so that the rotary slide valve is displaceable to a limited extent in a direction of its axis of rotation (14) and rotatable to a limited extent in relation to the rotary drive of the rotary slide valve (2).

5. A fuel-injection pump according to claim 4 in which the rotary position or displacement position of the rotary slide valve (2) is determined in dependence on an operating parameter of the internal combustion engine.

6. A fuel-injection pump according to claim 4 in which the rotary slide valve (2) is displaceable in a direction of its axis of rotation (14) against a stop adjustable in dependence on an operating parameter.

7. A fuel-injection pump according to claim 1, which the rotary slide valve (2) is displaceable in a direction of its axis of rotation (14) against a stop adjustable in dependence on an operating parameter.

8. A fuel-injection pump according to claim 1, in which the adjustable stop is formed by a stop piston (22) which can be subjected hydraulically to a speed-dependent pressure.

9. A fuel-injection pump according to claim 1, in which the rotary slide valve (2) is coupled to the rotary drive via oblique teeth or grooves.

10. A fuel-injection pump according to claim 4, in which the hollow driving wheel (14) of the rotary slide valve (2) is designed as a gearwheel meshing with a gearwheel (5) of a pump camshaft, and in that the gearwheel (5) of the pump camshaft has a smaller diameter than the hollow driving wheel (4) of the rotary slide valve (2).

11. A fuel-injection pump according to claim 1, in which the rotary slide valve (2) has on its circumference control grooves extending obliquely relative to the axis.

12. A fuel-injection pump according to claim 1, in which the circumferential grooves (16) of the rotary slide valve (2) have an axially measured width which is at least equal to the maximum axial displacement travel of the rotary slide valve (2) occurring during the rotation of the rotary slide valve (2) in relation to its rotary drive.

13. A fuel-injection pump according to claim 1, in which a circumferential groove (7) of the rotary slide valve (2) connected to the pump delivery connection (6) has a width in the axial direction corresponding to the maximum axial displacement travel of the rotary slide valve (2).

14. A fuel-injection pump according to claim 1 which includes a three-cylinder eccentric pump in which a transmission ratio of pump speed to engine speed is selected according to the factor (Z.120°)/720°, Z representing the number of engine cylinders.

15. A fuel-injection pump according to claim 7, in which the adjustable stop is formed by a stop piston (22) which can be subjected hydraulically to a speed-dependent pressure.

16. A fuel-injection pump according to claim 7, in which the rotary slide valve (2) is designed as a piston, the working space (11, 41) which can be subjected to a pressure medium counter to the force of a spring (27, 43) acting on the rotary slide valve (2).

17. A fuel-injection pump according to claim 7, in which the rotary slide valve (2) is coupled to the rotary drive via oblique teeth or grooves.

18. A fuel-injection pump according to claim 7, in which the rotary slide valve (2) has on its circumference control grooves extending obliquely relative to the axis.

19. A fuel-injection pump according to claim 7, in which the circumferential grooves (16) of the rotary slide valve (2) have an axially measured width which is at least equal to the maximum axial displacement travel of the rotary slide valve (2) occurring during the rotation of the rotary slide valve (2) in relation to its rotary drive.

20. A fuel-injection pump according to claim 7, in which a circumferential groove (7) of the rotary slide valve (2) connected to the pump delivery connection (6) has a width in the axial direction corresponding to the maximum axial displacement travel of the rotary slide valve (2).

21. A fuel-injection pump according to claim 7, in which the injection time and the injection period or quantity can be fixed by means of a solenoid valve (8, 39) which opens into the return line and which is connected to a delivery line (9, 28) of the pump or pumps, and in that the solenoid valve (8, 39) is connected to the return line (13, 42), with the working space (11, 41) of the rotary slide valve (2) designed as a piston or the working space of a regulating piston and a throttle being interposed.

22. A fuel-injection pump according to claim 7 which includes a three-cylinder eccentric pump in which a transmission ratio of pump speed to engine speed is selected according to the factor (Z.120°)/720°, Z representing the number of engine cylinders.

* * * * *